United States Patent [19]

Peters et al.

[11] Patent Number: 4,508,343

[45] Date of Patent: Apr. 2, 1985

[54] PINBALL GAME WITH RANDOMLY OPERABLE DROP TARGETS

[75] Inventors: Albin Peters, Chicago; Zeilik Fainzilberg, Lincolnwood, both of Ill.

[73] Assignee: Wico Corporation, Niles, Ill.

[21] Appl. No.: 435,978

[22] Filed: Oct. 22, 1982

[51] Int. Cl.[3] ..... A63F 7/00

[52] U.S. Cl. ..... 273/119 A; 273/127 R; 273/129 S; 273/1 ES

[58] Field of Search ..... 273/118–127 A, 273/127 R, 119 R

[56] References Cited

U.S. PATENT DOCUMENTS

| | | | |
|---|---|---|---|
| 3,275,322 | 9/1966 | Burnside | 273/119 A |
| 3,578,802 | 5/1971 | Murphy | 273/121 A |
| 3,997,163 | 12/1976 | Cooper et al. | 273/119 A |
| 4,093,232 | 6/1978 | Nutting et al. | 273/121 A |
| 4,221,384 | 9/1980 | Krynski | 273/121 A |
| 4,230,318 | 10/1980 | Dimond | 273/119 R |
| 4,438,929 | 3/1984 | Peters | 273/127 R |

*Primary Examiner*—Richard C. Pinkham
*Assistant Examiner*—Leo P. Picard
*Attorney, Agent, or Firm*—Emrich & Dithmar

[57] ABSTRACT

A pinball game includes a playfield board on which is mounted a plurality of drop target assemblies, each including a target member movable through an opening in the playfield board between a playing condition projecting above the playfield board and a retracted condition withdrawn beneath the playfield board, each target member being spring biased to its retracted condition and solenoid-actuated to its playing condition where it is latched in place. A programmable computer controls the sequence in which the target members are moved to their playing conditions. A manually controllable rotating shooter mechanism can be aimed to propel pinballs toward the raised target members. A display indicates the status of each target assembly.

8 Claims, 6 Drawing Figures

PINBALL GAME WITH RANDOMLY OPERABLE DROP TARGETS

BACKGROUND OF THE INVENTION

The present invention relates to pinball games and, in particular, to pinball games of the type wherein a rolling pinball is directed toward a plurality of target assemblies.

Various types of pinball games are known, including a variety of ball shooting devices for introducing the ball into play on the playfield board, and a number of different types of target assemblies or devices. Certain versions of these prior pinball games provide a manually aimable ball shooter so that the direction of the ball can be controlled as it enters the field of play. Furthermore, among the various types of target assemblies known are so-called drop target assemblies, wherein a target member is normally disposed above the playfield board in the path of rolling pinballs and which moves, in response to engagement by a rolling pinball, to a retracted position. However, typically, the games utilizing drop target assemblies have the position and number of target assemblies fixed and substantially unvarying from game to game.

SUMMARY OF THE INVENTION

The present invention relates to an improved pinball game, including an improved target assembly arrangement and mode of play.

It is an important object of this invention to provide a pinball game which includes a plurality of drop target assemblies wherein the movement of the target assemblies to their raised playing conditions varies from game to game.

It is another object of this invention to provide a pinball game of the type set forth, which effects programmed control of the movement of the target assemblies to their raised playing conditions.

Still another object of this invention is the provision of a pinball game of the type set forth, which includes display means associated with the target assemblies for indicating the status thereof.

It is yet another object of this invention to provide a pinball game of the type set forth, which includes an improved aimable ball propulsion means.

These and other objects of the invention are achieved by providing a pinball game including a playfield board, one or more pinballs and means for propelling a pinball into rolling engagement with the playfield board along a variable propulsion axis, the improvement comprising: a plurality of target assemblies mounted on the playfield board, each of the target assemblies being movable between a playing condition disposed for engagement by a pinball rolling along the playfield board and a retracted condition disposed out of the path of pinballs rolling along the playfield board, each of the target assemblies including means responsive to engagement thereof by a rolling pinball when the target assembly is in its playing condition for moving the target assembly to the retracted condition thereof, each of the target assemblies including drive means for effecting movement thereof to the playing condition thereof, and control means coupled to each of the drive means for automatically controlling the sequence in which the target assemblies are moved to the playing conditions thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
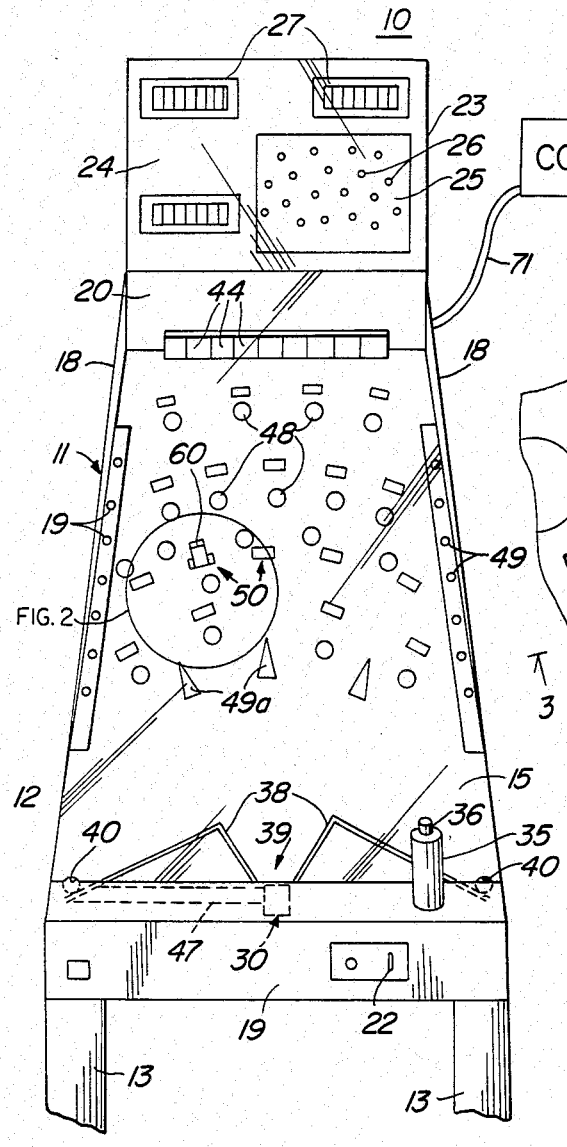
FIG. 1 is a fragmentary perspective view of a pinball game constructed in accordance with and embodying the features of the present invention.

Referring to FIG. 1 of the drawings, there is illustrated a pinball game generally designated by the numeral 10, constructed in accordance with and embodying the features of the present invention. The pinball game 10 has a cabinet 11 including a generally horizontally disposed rectangular bed 12, supported on a plurality of upstanding legs 13, the bed 12 including a rectangular flat playfield board 15 which is preferably inclined slightly downwardly and forwardly toward the player. The playfield board 15 has a flat planar upper surface 16 and a lower surface 17 (see FIG. 3) and is bounded along the opposite sides thereof respectively by a pair of side walls 18, by a front wall 19 and by a rear wall 20. Preferably, each of the side walls 18 and the rear wall 20 project upwardly a predetermined distance above the playfield board 15, the upper edges of the side walls 18 sloping downwardly toward the level of the playfield board 15 at the front edge thereof. If desired, the upper edges of the side walls 18, the front wall 19 and the rear wall 20 may be interconnected and covered by a transparent cover formed of glass or the like.

Figure 2:
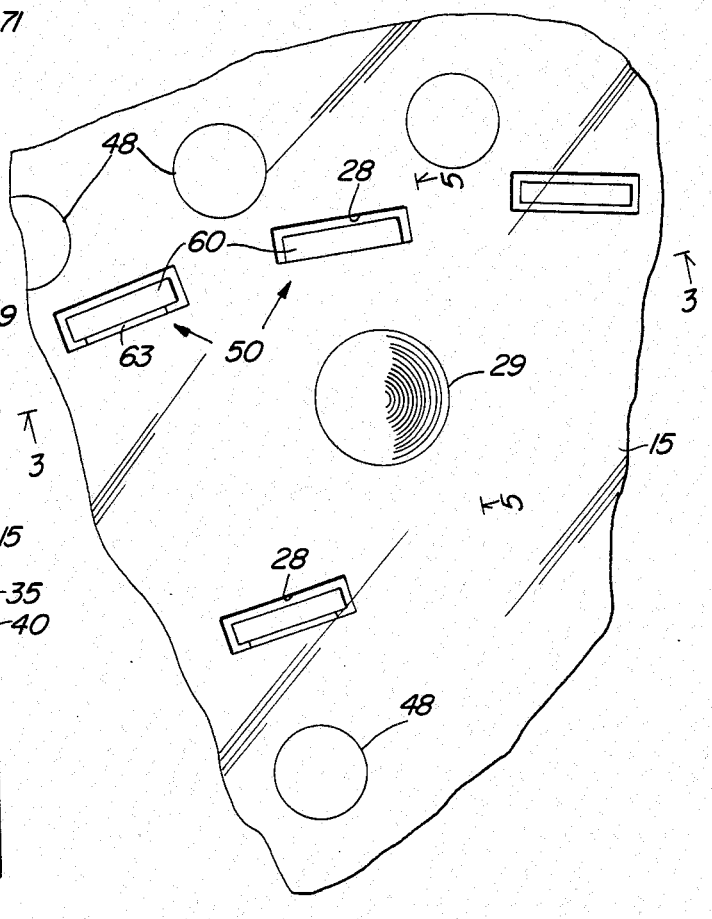
FIG. 2 is an enlarged, fragmentary, top plan view of a portion of the playfield board of the pinball game of FIG. 1.
Figure 3:
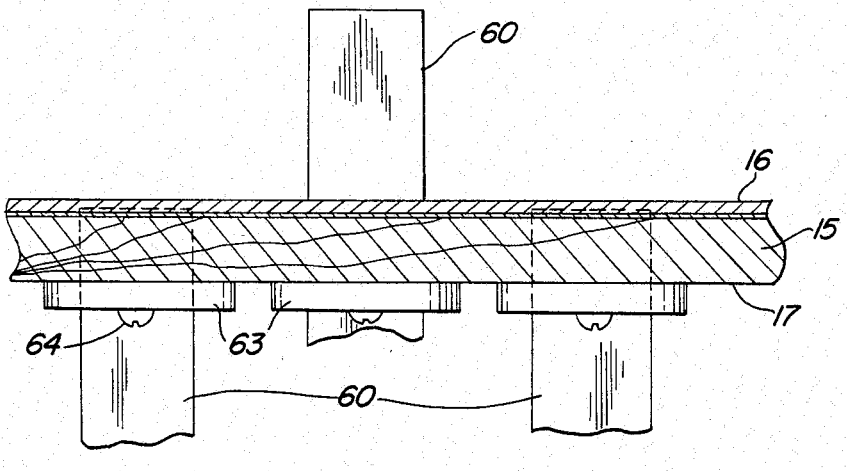
FIG. 3 is a fragmentary view in vertical section taken along the line 3—3 in FIG. 2.

Formed in the front wall 19 is a coin-receiving chute 22 which is connected to an actuating mechanism (not shown) internally of the pinball game 10 in a well known manner. Connected to the bed 12 at the rear end thereof is an upstanding rectangular housing 23 on which is mounted a rectangular display panel 24 provided with a map display 25 including a plurality of visible indicia 26, and a plurality of scoring displays 27. Referring also to FIGS. 2 and 3 of the drawings, there are formed in the playfield board 15 a plurality of rectangular slots or apertures 28. There are also provided a plurality of metal pin balls 29 in standard fashion.

Figure 4:
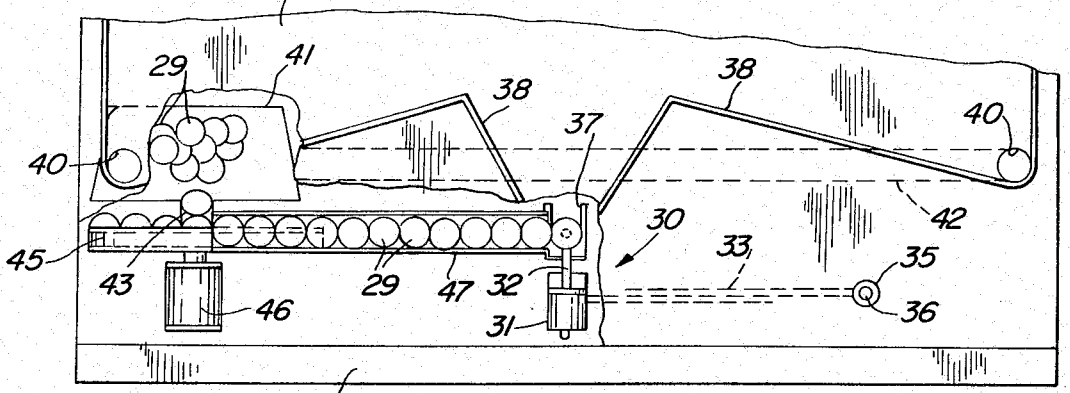
FIG. 4 is a fragmentary top plan view of a portion of the pinball game of FIG. 1, with parts of the playfield board broken away more clearly to show the underlying construction.

Referring now also to FIG. 4 of the drawings, there is mounted in the bed 12 adjacent to the front end thereof a rotatable shooter mechanism generally designated by the numeral 30, which includes a solenoid 31 provided with a plunger 32. Coupled to the solenoid 31 is a shooting socket or guide 37. The solenoid 31 is mounted on a rotatable support (not shown) which is coupled by a mechanical linkage 33 to the shaft of a control handle 35 which projects upwardly above the playfield board 15 (see FIGS. 1 and 4). Thus, for example, the mechanical linkage 33 could be an endless belt trained around sheaves on the shaft of the control handle 35 and the pivot shaft for the solenoid 31 so that rotation of the control handle 35 about its axis effects a corresponding rotation of the shooter mechanism 30 about its pivot axis. However, it will be appreciated that other types of linkages could be provided. Preferably, the control handle 35 is provided at its upper end with a manually-depressible fire control button 36 which is electrically connected to the solenoid 31 to control the actuation thereof. Thus, when the fire control button 36 is depressed, the solenoid 31 will be actuated to extend the plunger 32 thereof rapidly from the normal retracted position illustrated in FIG. 4 to an extended position for projecting a pinball 29 from the shooting socket 37 along a propulsion axis substantially coaxial with the plunger 32.

Carried by the playfield board 15 and projecting upwardly thereabove are two generally right angle guide rails 38, the short legs of which cooperate to define a guide chute 39 for redirecting pinballs 29 back to the shooting socket 37. The longer legs of the guide rails 38 respectively extend toward the front corners of the playfield board 15 for respectively directing pinballs 29 to two apertures 40, respectively formed in the playfield board 15. One of the apertures 40, in the left hand corner of the playfield board 15, as viewed in FIG. 1, communicates with a magazine 41 mounted beneath the playfield board 15 (see FIG. 4) for holding a supply of pinballs 29. The other one of the apertures 40 leads to an elongated chute or passage 42 which in turn slopes downwardly into the magazine 41. The playfield board 15 is also provided at the rear end thereof with a plurality of target pockets 44 (see FIG. 1) which communicate with another chute or passage (not shown) which also leads to the magazine 41. Thus, it will be appreciated that all pinballs 29 which are introduced into play on the playfield board 15, will ultimately be returned to the magazine 41.

The magazine 41 is provided at the lower front portion thereof with an exit trough 43 for feeding pinballs 29 one at a time from the magazine 41 to the lower portion of an elevator wheel 45 which is disposed for rotation about the axis of a horizontally disposed output shaft of a drive motor 46 (see FIG. 4). The elevator wheel 45 is of standard construction and is provided with a plurality of circular openings therein equiangularly spaced apart around the periphery thereof, and each adapted to receive therein a single pinball 29. The top of the elevator wheel 45 communicates with one end of a feed chute 47 which is inclined downwardly from the elevator wheel 45 and has the other end thereof disposed in communication with the shooting socket 37 of the shooter mechanism 30.

Preferably, the elevator wheel 45 operates intermittently, being indexed one ball-opening at a time, either in response to insertion of a coin in the coin chute 22, or in response to actuation of a ball feed control switch (not shown) by the player, or in response to return of ball to the magazine 41, all in a well known manner. Furthermore, it will be appreciated that the ball feeding apparatus may be so arranged as to keep the feed chute 47 filled, there being provided at the exit end of the feed chute 47 a gate which may be indexed simultaneously with the elevator wheel 45. Alternatively, the system could be arranged so that there is only one ball at a time in the feed chute 47, being introduced thereinto by the elevator wheel 45 on demand.

The playfield board 15 is preferably provided with a plurality of indicia 48, and with a plurality of indicia 49 arrayed in two rows respectively extending along the opposite sides of the playfield board 15. Further indicia **49*a* are also indicated in FIG. 1. It will be appreciated that suitable indicia could be arranged in any desired pattern in a well known manner. Preferably, the indicia 48 are respectively associated with drop-target assemblies, each generally designated by the numeral 50**, and all being substantially identical in construction, wherefore only one will be described in detail.

Figure 6:
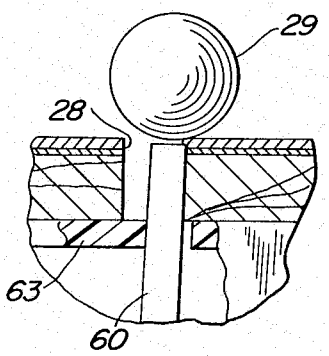
FIG. 6 is a fragmentary view similar to FIG. 5, illustrating the target assembly in its retracted condition.
Figure 5:
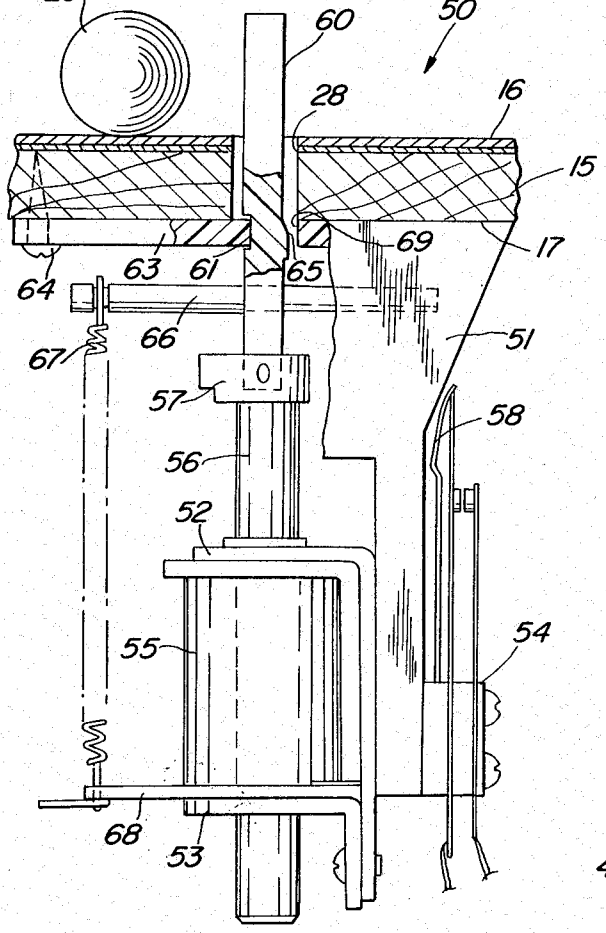
FIG. 5 is a fragmentary view in vertical section taken along the line 5—5 in FIG. 2, with portions of the structure broken away and with the target assembly indicated in its playing condition.

Each of the drop target assemblies 50 is preferably of the type disclosed in copending U.S. application Ser. No. 289,371 filed Aug. 3, 1981, although it will be appreciated that other types of drop target assemblies could be used. Referring also to FIGS. 5 and 6 of the drawings, the drop target assembly 50 includes a frame 51 fixedly secured to the lower surface 17 of the playfield board 15 adjacent to one of the slots 28 therein. The frame 51 depends from the playfield board 15 and carries thereon two angle brackets 52 and 53 which cooperate to mount therebetween a solenoid 55. Also carried by the frame 51 is a leaf switch 54 connected to the coil of the solenoid 55. The solenoid 55 is mounted with the axis thereof disposed vertically and is provided with a plunger 56 which projects upwardly therefrom, the plunger 56 being coupled at the upper end thereof by means of a pivot joint 57 to the lower end of a rectangular target member 60 which is disposed substantially in alignment with the axis of the plunger 56 and has the upper end thereof projecting into the associated slot 28 in the playfield board 15.

The plunger 56 is movable between a fully extended or playing condition illustrated in FIG. 5, wherein the target member projects a predetermined distance above the upper surface 16 of the playfield board 15, and a retracted position, illustrated in FIG. 6, wherein the upper end of the target member 16 is disposed beneath the upper surface 16 of the playfield board 15, but still within the slot 28. Formed in the front surface of the target member 60 is a shallow rectangular recess 61 which is dimensioned to receive therein one end of a latch plate 63 which is fixedly secured to the lower surface 17 of the playfield board 15, as by fasteners 64, and has one edge thereof projecting a slight distance directly beneath the slot 28. Formed on the rear surface of the target member 60 is a projecting cam surface 65 which is disposed for engagement with an edge 69 of the frame 51, in a manner to be explained below.

Extending through a complementary aperture in the target member 60 and fixedly secured thereto substantially normal to the axis of the solenoid 55 is an elongated pin 66. One end of the pin 66 projects forwardly from the target member 60 and is coupled to one end of a helical tension spring 67, the other end of which is anchored to a plate 68 secured to the bracket 53. The other end of the pin 66 projects rearwardly from the target member 60 and is disposed for engagement with an actuator member 58 of the control switch 54.

Preferably, the pinball game 10 is so arranged that the indicia 26 on the map display 25 respectively correspond to the drop target assemblies 50. Furthermore, the indicia 26, the indicia 48 and the drop target assemblies 50 are all interconnected with each other and with a computer 70, the connection to the computer 70 being through a cable 71. The computer 70 is preferably a programmable digital microprocessor and, while it has been diagrammatically illustrated outside the cabinet 11, it will be appreciated that it could be disposed within the cabinet 11, either within the bed 12 or within the housing 23. The computer 70 operates to control the sequence in which the drop target assemblies 50 are moved to the playing conditions thereof. Thus, for example, the computer 70 may be connected through suitable circuitry to the control switches 54 of the drop target assemblies 50 for introducing control signals thereto for operating the solenoids 55 in a predetermined sequence which may be random or regular, depending upon the programming of the computer 70.

The operation of the pinball game 10 will now be described in detail. The game is begun by the insertion of a coin into the coin chute 22. This will operate to introduce one or more pinballs 29 to the feed chute 47, depending upon the arrangement of the system, the first pinball 29 being introduced into the shooting socket 37 of the shooter mechanism 30. Also, the program of the computer 70 will be initialized to place the pinball game 10 and, in particular, the drop target assemblies 50 thereof in their initial start-of-game conditions, wherein one or more of the drop target assemblies 50 will be disposed in the playing condition thereof, and the indicia 26, 48, 49, and 49*a* and the scoring displays 27 will all assume their initial conditions. Preferably, the map display 25 comprises a map of the status of the drop target assemblies 50 which may, for example, give a visual indication of which of the drop target assemblies 50 have been moved to a playing condition and which have been "dropped" to a retracted position by being impacted by a pinball 29. In FIG. 1 the pinball game 10 has been illustrated, by way of example, in an initial condition in which one of the drop target assemblies 50 is in its playing condition.

To initiate play the player utilizes the control handle 35 to aim the shooting socket 37 toward the raised target member 60, and then depresses the fire control button 36 to actuate the solenoid 31 for firing the pinball 29, i.e., projecting it from the shooting socket 37 toward the raised target member 60. If the pinball 29 misses the raised target member 60, it may continue on to the rear of the playfield board 15 and pass into one of the target pockets 44 for return to the magazine 41, it may roll over or impact other scoring devices (not shown) on the playfield board 15, or it may return via the apertures 40 to the magazine 41. In this regard, it will be appreciated that, if desired, other ball accelerating mechanisms such as kicker targets or flippers or the like could be provided on the playfield board 15. The spent pinball 29 may also return via the chute 39 to the shooting socket 37, thereby giving the player another shot with the same pinball 29. If the spent pinball 29 is returned to the magazine 41, it may actuate a suitable switch (not shown) in a well known manner to feed another pinball 29 to the shooting socket 37.

If the raised target member 60 is impacted by the pinball 29, it will be deflected rearwardly (to the right as viewed in FIG. 5), this rearward deflecting movement being accommodated by the pivot joint 57, to unlatch the target member 60 from the latch plate 61. This rearward deflection of the target member 60 will also cause the cam surface 65 to be driven into camming engagement with the edge 69 of the frame 51 positively to drive the target member downwardly a slight distance so that it cannot rebound back into latching engagement with the latch plate 63, it being appreciated that the tension spring 67 resiliently urges the target member 60 forwardly toward this latched condition. The spring 67 also resiliently urges the target member downwardly to its retracted position and will return it to this retracted position when it is unlatched by the pinball 29, all as is explained in greater detail in the aforementioned copending application Ser. No. 289,371. As the target member 60 drops to its retracted position, the rear end of the pin 66 moves into camming engagement with the actuator 58 driving it rearwardly to close the contacts of the leaf switch 54, thereby enabling the solenoid 55. Thus, when a suitable drive signal is later fed to the drop target assembly 50 from the computer 70, it will be passed by the closed switch 54 to the coil of the solenoid 55 for energizing it and returning the target member 60 to its playing condition.

Preferably, the computer 70 is programmed to respond to the dropping of a raised target member 60 for automatically actuating one or more of the others of the drop target assemblies 50 to their playing conditions, the changing status of the drop target assemblies 50 being reflected in the map display 25. Also, suitable scoring and indicia thereof will result from the dropping of each of the drop target assemblies 50. The drop target assemblies 50 may be oriented so that the target members 60 in the raised or playing condition thereof will, upon direct impact by a pinball 29, serve to deflect the pinball 29 back toward the chute 39 for returning the pinball 29 to the shooting socket 37 to give the player another shot. Alternatively, for example, the pinball game 10 could be so arranged that each successful dropping of a drop target assembly 50 may give the player another "free" ball. It will be appreciated that many variations of the mode of play are possible.

From the foregoing, it can be seen that there has been provided an improved pinball game which is characterized by automatic control of a plurality of drop target assemblies to move them to their raised or playing conditions in a preprogrammed sequence.

We claim:

1. In a pinball game including a playfield board and one or more pinballs, the improvement comprising: means for propelling a pinball into rolling engagement with the playfield board along a variable propulsion axis, said propelling means including socket means for receiving a pinball in a set position from which it is propelled; a plurality of target assemblies mounted on said playfield board, each of said target assemblies including a single target member movable between a playing condition disposed for engagement by a pinball rolling along the playfield board and a retracted condition disposed out of the path of pinballs rolling along the playfield board, means responsive to engagement of said target member by a rolling pinball when said target member is in its playing condition for moving said target member to the retracted condition thereof, and drive means for effecting movement of said target member to the playing condition thereof independently of the target members of the others of said target assemblies; control means coupled to each of said drive means for controlling the operation thereof independently of one another automatically to control the sequence in which said target members are moved to the playing conditions thereof; guide means for returning a pinball from the playfield board to said socket means; and means for manually varying the direction of said propulsion axis.

2. The pinball game of claim 1, wherein said control means is electronic.

3. The pinball game of claim 1, wherein said control means is a programmable computer.

4. The pinball game of claim 1, wherein said target member projects a predetermined distance above the playfield board in the playing condition of said target assembly and is disposed beneath the playfield board in the retracted condition of said target assembly.

5. The pinball game of claim 4, wherein the playfield board has a plurality of openings therein respectively receiving said target members therethrough.

6. The pinball game of claim 1, wherein the means for propelling the pinball includes rotatable means for continuously varying the direction of the propulsion axis.

7. The pinball game of claim 6, and further including means for selectively controlling the actuation of said ball propulsion means.

8. The pinball game of claim 1, and further including indicia means coupled to said control means and to said target assemblies for indicating the status of each of said target assemblies.

* * * * *